US006326742B1

(12) United States Patent
Iwasaki et al.

(10) Patent No.: US 6,326,742 B1
(45) Date of Patent: Dec. 4, 2001

(54) COLOR CRT WITH CROSS-MISCONVERGENCE CORRECTION DEVICE

(75) Inventors: Katsuyo Iwasaki, Nishinomiya; Etsuji Tagami, Takatsuki, both of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/421,858

(22) Filed: Oct. 20, 1999

(30) Foreign Application Priority Data

Oct. 28, 1998 (JP) ..... 10-306591

(51) Int. Cl.[7] ..... H01J 29/70
(52) U.S. Cl. ..... 315/370; 313/440
(58) Field of Search ..... 315/370, 368.11, 315/368; 313/440, 412; 335/213

(56) References Cited

U.S. PATENT DOCUMENTS 4,547,707 * 10/1985 Yabase ..... 315/368
5,070,280 * 12/1991 Okuyama et al. ..... 315/368.11
5,838,099 * 11/1998 Hichiwa et al. ..... 313/440

FOREIGN PATENT DOCUMENTS 6380756 5/1988 (JP) .
6484549 3/1989 (JP) .

* cited by examiner

*Primary Examiner*—Don Wong
*Assistant Examiner*—James Clinger
(74) *Attorney, Agent, or Firm*—Price and Gess

(57) ABSTRACT

A color cathode ray tube is composed of a glass bulb which has a front panel and a fluorescent screen set on an inner surface of the front panel, an in-line electron gun which is provided in the glass bulb and projects electron beams onto the fluorescent screen, a deflection means including horizontal and vertical deflection coils arranged outside the glass bulb, and a correction device for correcting cross-misconvergence. The correction device is provided with four correction coils that are respectively set for the four quadrants of a rectangular deflection region of the electron beams. The strength of the corrective magnetic fields generated by the correction coils becomes largest when the electron beams are deflected to a horizontal strip in the central part of both the upper and lower halves of the deflection region, and becomes nearly 0 when the electron beams are deflected to areas around the horizontal axis and top and bottom edges of the deflection region.

13 Claims, 7 Drawing Sheets

COLOR CRT WITH CROSS-MISCONVERGENCE CORRECTION DEVICE

BACKGROUND OF THE INVENTION (1) Field of the Invention

The present invention relates to a color cathode ray tube (CRT) used as a monitor, a television receiver, or the like, and particularly relates to a means that corrects cross-misconvergence occurring in a horizontal strip in the central part of both the upper and lower halves of a fluorescent screen of the color CRT.

(2) Related Art

When blue and red rasters are projected onto a fluorescent screen of a conventional color CRT provided with an in-line type electron gun, so-called "cross-misconvergence" occurs as shown in FIG. 1. This cross-misconvergence takes place due to a delicate interrelationship between a distorted distribution of a magnetic field generated by a deflection device (or, a deflection yoke) and a shape of an inner surface of a front panel of the color CRT.

The cross-misconvergence refers to a phenomenon in which blue and red rasters vertically deviate from each other in a horizontal strip in the central part of both the upper and lower halves of the effective display region of a fluorescent screen 50. As shown in FIG. 1, the upper half includes a first quadrant indicated as (I) and a second quadrant indicated as (II), while the lower half includes a third quadrant as (III) and a fourth quadrant as (IV). Hereinafter, each horizontal strip in the central parts of the quadrants is referred to as the "central strip."

As shown in FIG. 1, blue rasters 1B to 4B and red rasters 1R to 4R are projected in different slanting directions. In the quadrants (I) and (III), blue rasters 1B and 3B drawn in dashed lines are located respectively above red rasters 1R and 3R drawn in solid lines. In the quadrants (II) and (IV), blue rasters 2B and 4B are located respectively below red rasters 2R and 4R.

Here, Japanese Laid-Open Patent No. 64-84549 discloses a method to reduce the occurrence of such cross-misconvergence. This method is specifically explained as follows. Vertical deflection coils of a deflection device include a pair of coils for generating magnetic fields distorted in a pincushion and a pair of coils for generating magnetic fields distorted in a barrel. Two diodes in parallel, with their polarities being opposite, are connected in series to the pair of coils generating the pincushion magnetic fields. With this construction, the magnetic field is switched between the pincushion and barrel magnetic fields at a timing at which electron beams are deflected to the central strip, in order that the stated cross-misconvergence can be prevented.

Meanwhile, Japanese Laid-Open Utility Model No. 63-80756 discloses another method of correcting cross-misconvergence. In the disclosure, at least four permanent magnets are set around a front rim of a bobbin of a deflection device, each permanent magnet having the magnetic poles parallel to the axial direction of the bobbin and being set on an extended diagonal line of the bobbin. By means of these permanent magnets, raster distortion and cross-misconvergence in the central strips can be simultaneously corrected.

Although the cross-misconvergence is reduced using the method disclosed in the former reference, the linearity of vertical rasters is deteriorated due to sudden switches from the barrel magnetic field to the pincushion magnetic field. This leads to deterioration in images displayed on the fluorescent screen of the CRT.

Using the technique disclosed in the latter reference, meanwhile, because of the permanent magnets, cross-misconvergence next occurs in areas around the horizontal axis of the fluorescent screen, where it has never occurred. Thus, although the cross-misconvergence occurring in the central strips is corrected, convergence quality of the entire screen cannot be improved.

SUMMARY OF THE INVENTION

It is therefore an object of the present invention to provide a color cathode ray tube which reduces cross-misconvergence using a construction that can be easily realized at low costs without deteriorating the linearity of vertical rasters and causing misconvergence to other areas of the fluorescent screen.

The object of the present invention can be achieved by a color cathode ray tube made up of: a glass bulb which has a front panel and a fluorescent screen that is set on an inner surface of the front panel; an in-line electron gun which is provided in the glass bulb and projects a plurality of electron beams onto the fluorescent screen; a deflection unit including a horizontal deflection coil that deflects the electron beams in a horizontal direction and a vertical deflection coil that deflects the electron beams in a vertical direction, the horizontal and vertical deflection coils being arranged outside the glass bulb; and a correction unit for generating a corrective magnetic field that is used for correcting cross-misconvergence, a strength of the corrective magnetic field being changed in accordance with an amount of deflection of the electron beams in the vertical direction.

With this construction, the corrective magnetic fields having a strength appropriate to the amount of cross-misconvergence can be generated, thereby reliably correcting the cross-misconvergence that changes with the amount of deflection of the electron beams.

The cross-misconvergence can be corrected more effectively by the color cathode ray tube having the correction unit that changes the strength of the corrective magnetic field so that the strength affecting the electron beams becomes largest when the electron beams are deflected to an area where a greatest amount of correction for the cross-misconvergence is needed and that the strength affecting the electron beams becomes smallest when the amount of deflection of the electron beams in the vertical direction is zero.

The correction unit includes: a plurality of correction coils which respectively generate corrective magnetic fields; and a control unit which controls a current to be supplied to the correction coils. The control unit increases the current to be supplied to the correction coils in accordance with the amount of deflection of the electron beams in the vertical direction, wherein each of the correction coils is formed by winding a solenoid around a saturable core, a strength of the corrective magnetic fields being largest when the current supplied to the correction coils reaches a predetermined value and being decreased owing to saturation of the saturable cores after the current exceeds the predetermined value.

With this simple construction, when the electron beams are deflected to the horizontal axis of the fluorescent screen, the strength of the corrective magnetic fields generated by the correction coils is small. Meanwhile, when the electron beams are deflected to a horizontal strip in the central part of the upper or lower half of the fluorescent screen, the strength of the corrective magnetic fields is largest. Thereafter, as the electron beams are deflected upward or downward to reach the top or bottom edge of the screen, the current supplied from the vertical deflection coils is increased and then the saturable cores are saturated. After the saturation of the saturable cores, the strength of the magnetic fields decreases. Since the correction coils operate in the saturation region of the saturable cores, the strength of the magnetic fields generated by the correction coils can be set largest when the electron beams are deflected to the areas where the correction for cross-misconvergence is needed.

Moreover the control unit supplies a current to the correction coils, the current changing proportional to a vertical deflection current supplied to the vertical deflection coil. As a result, the current is supplied to the correction coils in sync with the vertical deflection of the electron beams, and is increased in accordance with the amount of deflection of the electron beams.

The current changing proportional to the vertical deflection current refers to a current that changes in the same cycle as the vertical deflection current and whose current value changes proportional to the current value of the vertical deflection current. In this case, a factor of proportionality may be 1.

BRIEF DESCRIPTION OF THE DRAWINGS

These and other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENTS

The following is a description of an embodiment of the present invention, with reference to the drawings.

Figure 1:
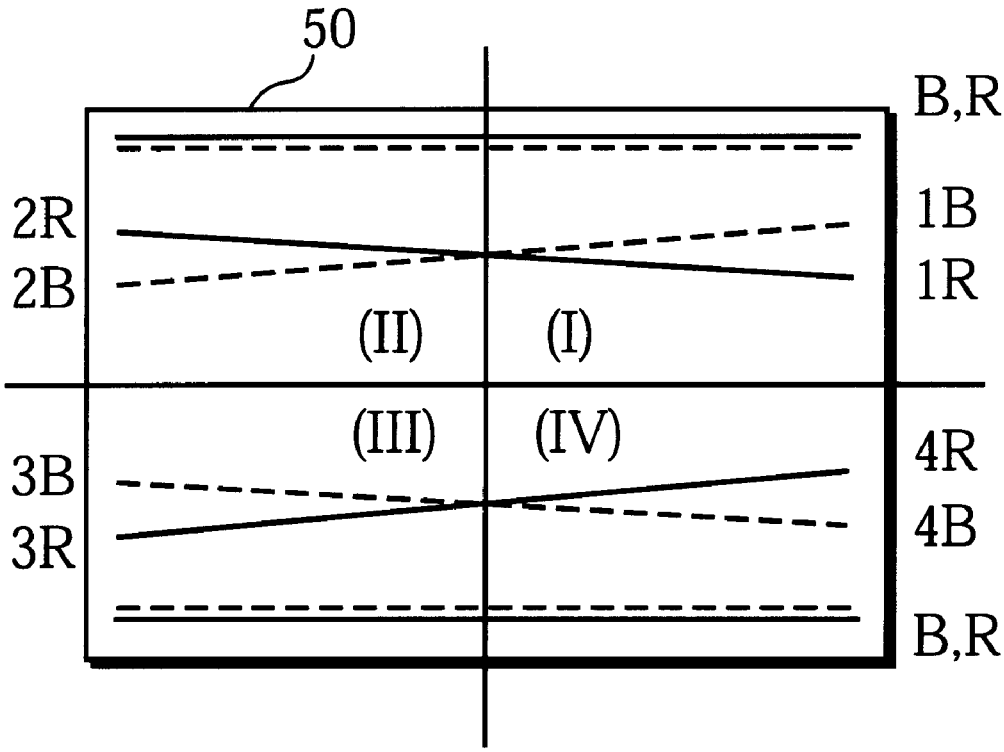
FIG. 1 is a view to help explain cross-misconvergence occurring to a fluorescent screen of a conventional color CRT.
Figure 2:
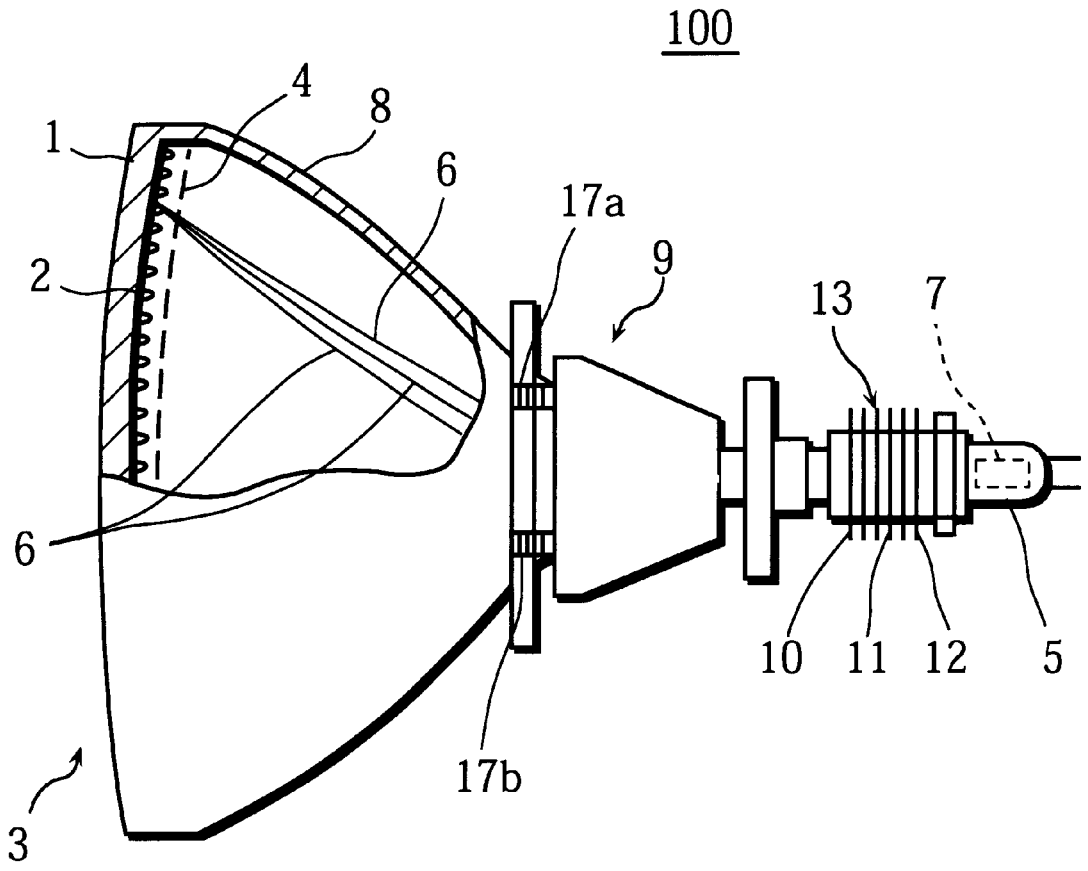
FIG. 2 is a side view, partially broken away, of a color CRT of an embodiment of the present invention.

FIG. 2 is a side view, partially broken away, of a color CRT 100 of the embodiment of the present invention. As shown in FIG. 2, the color CRT 100 is composed of a glass bulb 3, a shadow mask 4, and an in-line electron gun 7. The glass bulb 3 includes a three-color fluorescent screen 2 that emits red, green, and blue lights and is provided on an inner surface of a front panel 1. The shadow mask 4 is set facing the fluorescent screen 2. The in-line electron gun 7 is arranged in a neck 5 of the glass bulb 3 and projects electron beams 6 to the fluorescent screen 2.

A deflection device 9 is provided outside the glass bulb 3 between a funnel 8 and the neck 5. A convergence unit 13 is set outside the neck 5 between the deflection device 9 and the in-line electron gun 7. The convergence unit 13 includes a two-pole magnet 10, a four-pole magnet 11, and a six-pole magnet 12 that are used for adjusting purity and static convergence.

Figure 3:
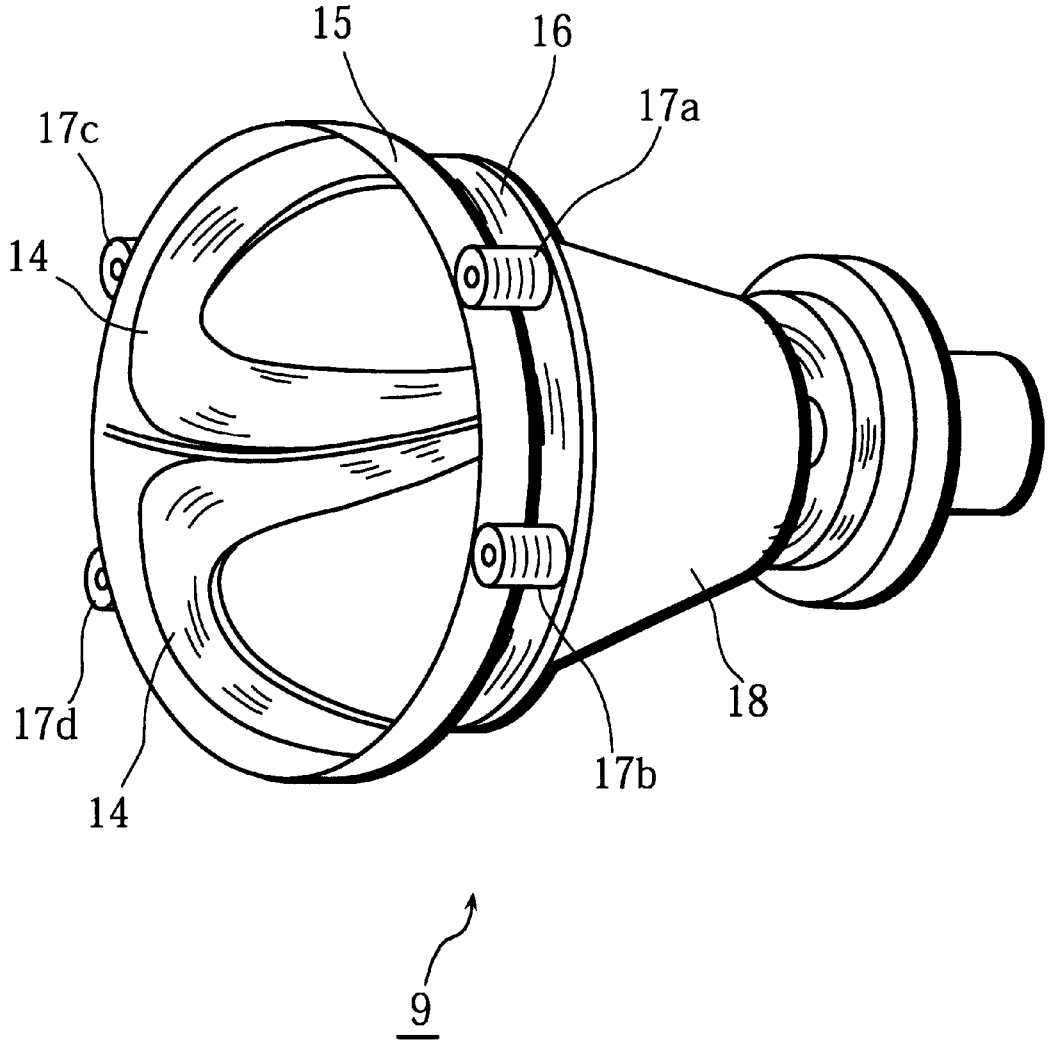
FIG. 3 is an enlarged perspective view of a deflection device that is provided with deflection coils and correction coils.

FIG. 3 is an enlarged perspective view of the deflection device 9. The deflection device 9 is composed of a pair of horizontal deflection coils 14 and a pair of vertical deflection coils 16 that are set integral with each other via a resin frame 15 that serves as an insulator and supporter. The pair of horizontal deflection coils 14 generates a horizontal deflection magnetic field that has a pincushion distortion on the whole. The pair of vertical deflection coils 16 generates a vertical deflection magnetic field that has a barrel distortion on the whole. A ferrite core 18 is set outside the cone portion of the deflection device 9.

Figure 7:
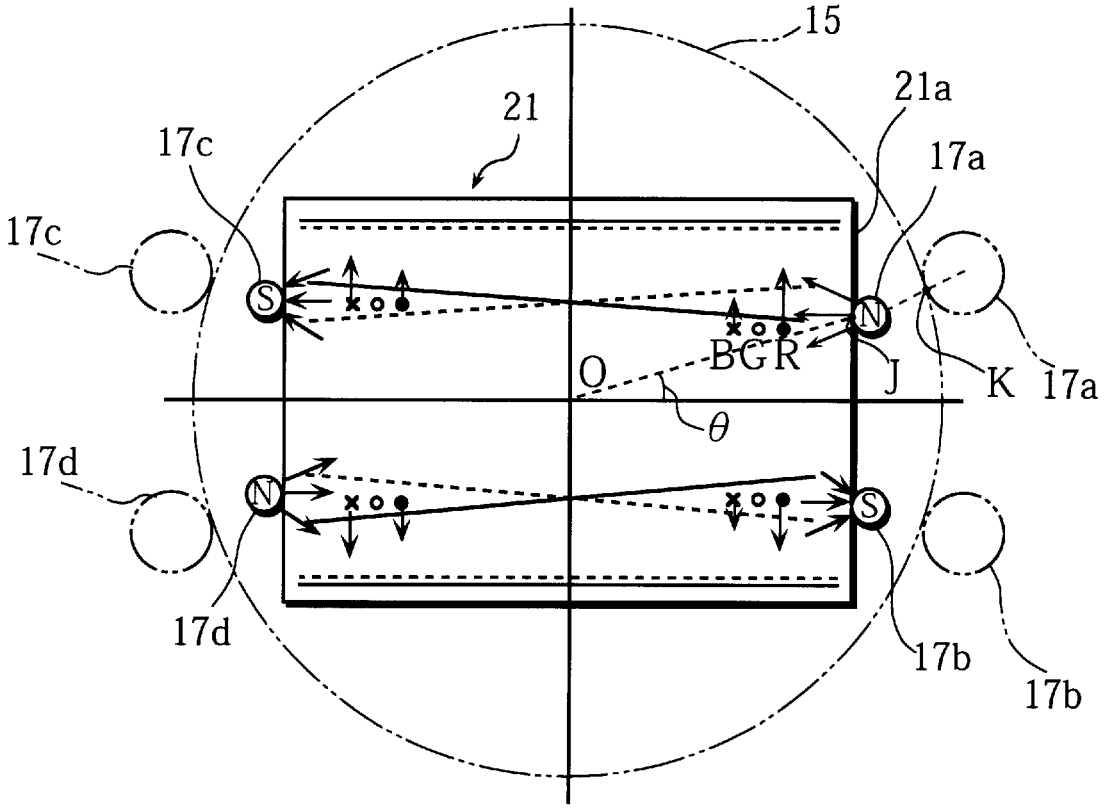
FIG. 7 is a view to help explain how the cross-misconvergence is corrected by the magnetic fields generated by the correction coils.

Four correction coils 17*a*, 17*b*, 17*c*, and 17*d* are set around the resin frame 15 at a front rim located closer to the fluorescent screen 2, via resin holders (not shown). As shown in FIG. 7 described later, the correction coils 17*a* to 17*d* are arranged outside a rectangular deflection region 21 that is nearly inscribed in a section of the glass bulb 3 by a plane perpendicular to the axis of the glass bulb 3. To be more specific, the correction coils 17*a* to 17*d* are set to the right and left of the deflection region 21 no lower than the bottom edge and no higher than the top edge of the deflection region 21. The correction coils 17*a* to 17*d* are respectively provided for the four quadrants of the deflection region 21.

Each of the correction coils 17*a* to 17*d* is formed by solenoidally winding a coil around a saturable-type ferrite core. As described in detail later, the correction coils 17*a* to 17*d* respectively correct the cross-misconvergence through generating magnetic fields whose strengths change in accordance with the amounts of vertical deflection of the electron beams. The magnetic fields generated by the correction coils 17*a* to 17*d* may be referred to as the "corrective magnetic fields" hereinafter.

Figure 4:
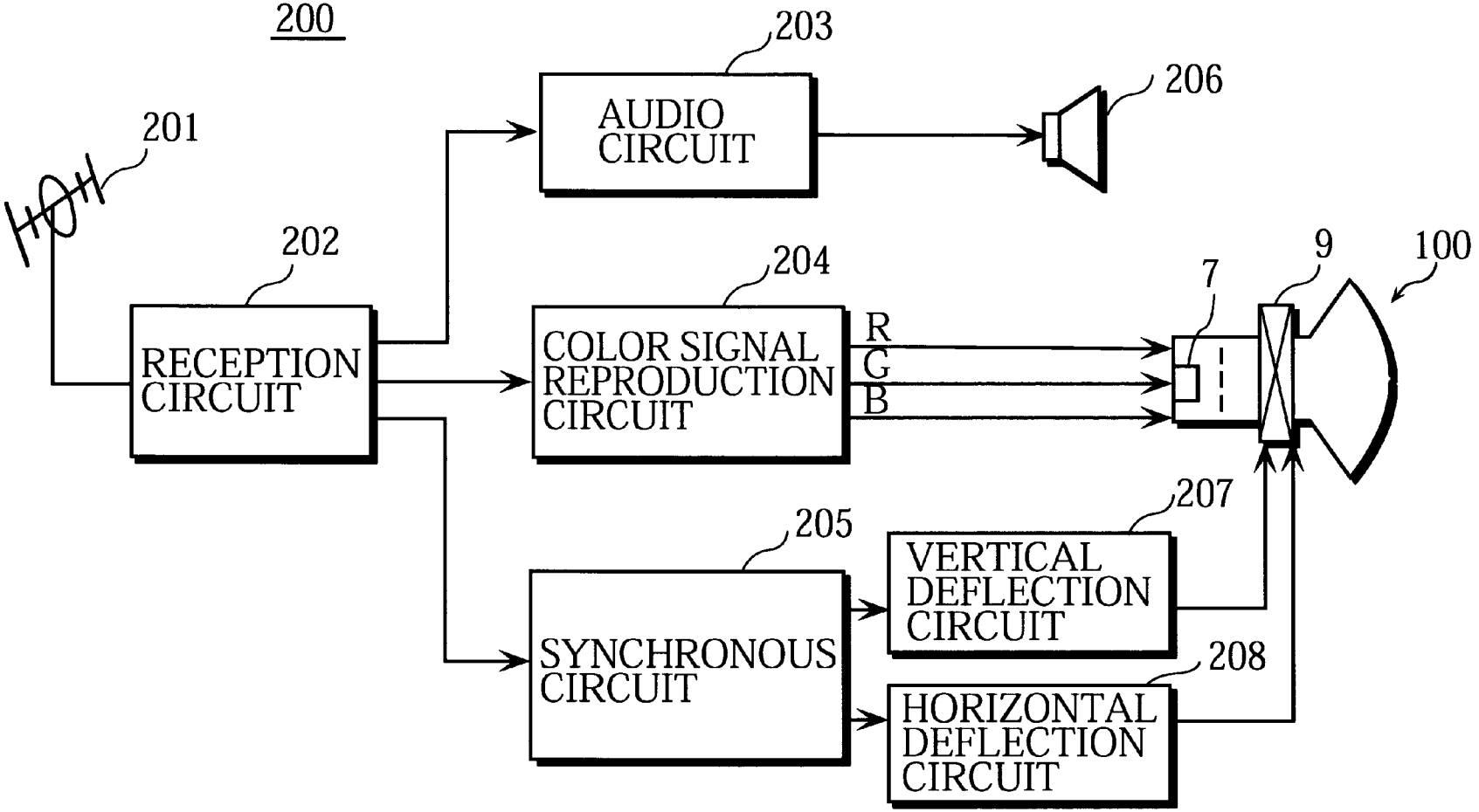
FIG. 4 is a block diagram showing a circuit configuration of a television receiver that employs the color CRT of the present invention.

FIG. 4 is a schematic block diagram showing a circuit: configuration of a television receiver 200 in which the color CRT 100 of the present invention is used.

As shown in FIG. 4, the television receiver 200 is composed of a reception circuit 202, an audio circuit 203, a color signal reproduction circuit 204, a synchronous circuit 205, a speaker 206, a vertical deflection circuit 207, a horizontal deflection circuit 208, and a color CRT 100.

The reception circuit 202 detects television signals received via an antenna 201 and separates the signals into audio, video, and synchronous signals. Then, these three kinds of signals are respectively transmitted to the audio circuit 203, the color signal reproduction circuit 204, and the synchronous circuit 205.

The audio circuit 203 reproduces audio by driving the speaker 206, in accordance with the received audio signals.

The color signal reproduction circuit 204 demodulates R (red), G (green), and B (blue) signals in accordance with the received video signals. Then, the color signal reproduction circuit 204 applies voltages appropriate to the color signals to the in-line electron gun 7, so that the in-line electron gun 7 projects three electron beams corresponding to R, G, and B.

The synchronous circuit 205 separates the received synchronous signals into vertical and horizontal synchronous signals, and then transmits these two kinds of synchronous signals respectively to the vertical deflection circuit 207 and the horizontal deflection circuit 208. In accordance with the received vertical and horizontal synchronous signals, the circuits 207 and 208 generate sawtooth currents respectively as a vertical deflection current and a horizontal deflection current. Then, the circuits 207 and 208 supply the vertical and horizontal deflection currents respectively to the pair of the vertical deflection coils 16 and the pair of the horizontal deflection coils 14 of the deflection device 9. Accordingly, the electron beams 6 associated with R, G, and B are cyclically deflected in respective directions, thereby performing raster scanning on the fluorescent screen 2.

Figure 5:
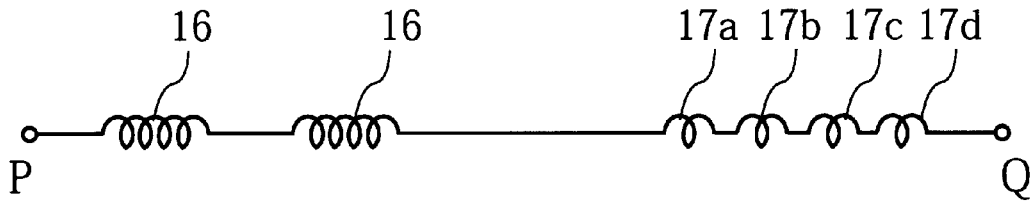
FIG. 5 shows a connection state of the correction coils and vertical deflection coils.

FIG. 5 is a view showing a connection state of the correction coils 17*a* to 17*d* and the pair of vertical deflection coils 16.

As shown in FIG. 5, the correction coils 17*a* to 17*d* are connected in series to the pair of vertical deflection coils 16. The vertical deflection current generated by the vertical deflection circuit 207 is supplied between P and Q. The correction coils 17*a* to 17*d* are arranged so that directions of their magnetic poles (or, axial directions of the cores) are parallel to the axis of the glass bulb 3. Also, each of the correction coils 17*a* to 17*d* is set so that its north or south magnetic pole faces the fluorescent screen 2 as described next with reference to FIG. 6.

Figure 6:
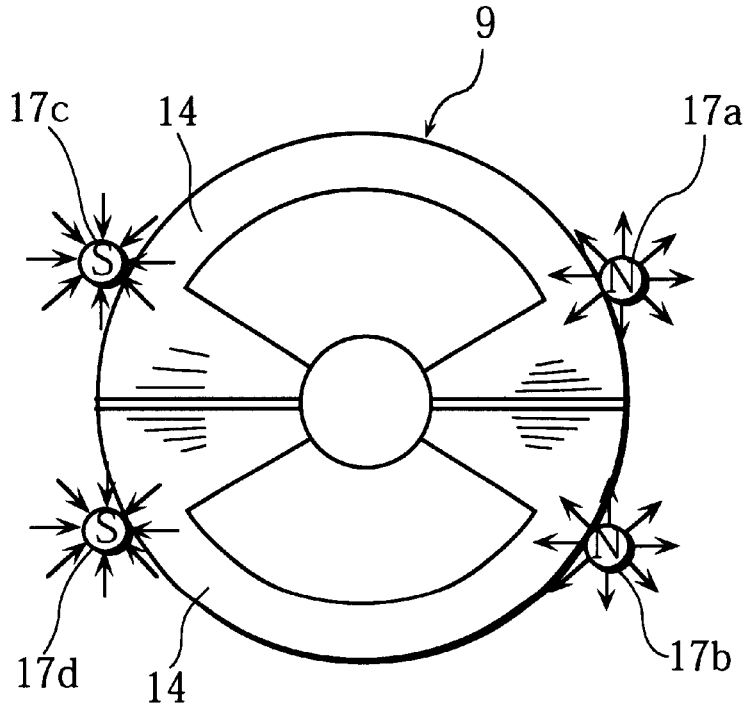
FIG. 6 shows directions of magnetic fields generated by the correction coils when the electron beams are deflected upward.

FIG. 6 shows the magnetic poles and the directions of the magnetic fields generated by the correction coils 17*a* to 17*d* of the deflection device 9 viewed from the front. Note that FIG. 6 shows the directions of the magnetic fields generated by the correction coils 17*a* to 17*d* when the electron beams 6 are projected to the upper half of the fluorescent screen 2 (referred to as the "upward deflection" hereinafter).

As shown in FIG. 6, the magnetic poles facing the fluorescent screen 2 are the same for the correction coils located on the right-hand side with respect to the vertical axis, and also the same for the correction coils located on the left-hand side with respect to the vertical axis. Specifically, the north poles of the correction coils 17*a* and 17*b* are facing the fluorescent screen 2, while the south poles of the correction coils 17*c* and 17*d* are facing the fluorescent screen 2. Meanwhile, when the electron beams 6 are projected to the lower half of the fluorescent screen 2 (referred to as the "downward deflection" hereinafter), the vertical deflection current generated by the vertical deflection circuit 207 is supplied in the opposite direction to the case of the upward deflection. Thus, the directions of the magnetic fields generated for the downward deflection are opposite to the directions for the upward deflection. To be more specific, the south poles of the correction coils 17*a* and 17*b* are facing the fluorescent screen 2, while the north poles of the correction coils 17*c* and 17*d* are facing the fluorescent screen 2.

FIG. 7 is a view to help explain how the cross-misconvergence is corrected through the magnetic fields generated by the correction coils 17*a* to 17*d*. It should be noted here that, for convenience of explanation, the directions of the magnetic fields of the correction coils 17*b* and 17*d* located lower side with respect to the horizontal axis are opposite to the directions shown in FIG. 6 since the lower half of the deflection region 21 of FIG. 7 shows a case of the downward deflection.

Attention is first focused on the electron beams 6 currently being projected to the vicinity of the correction coil 17*a* provided for the first quadrant. As can be understood from the construction of the in-line electron gun 7, the electron beam 6 that is projected onto a red-emitting fluorescent material (this beam 6 is indicated as R in FIG. 7) is situated outermost as compared with the other electron beams 6 associated with G and B. This is to say, the electron beam 6 associated with R comes nearest to the correction coil 17*a*. As such, this electron beam 6 is most affected by the corrective action of the corrective magnetic field generated by the correction coil 17*a*, as indicated by the longest up arrow in FIG. 7.

Meanwhile, the electron beam 6 that is projected onto a blue-emitting fluorescent material (this beam 6 is indicated as B in FIG. 7) is situated away from the correction coil 17*a* as compared with the other electron beams 6. Thus, the electron beam 6 associated with B is least affected by the corrective action by the magnetic field generated by the correction coil 17*a*, as indicated by the shortest up arrow in FIG. 7.

Consequently, the electron beam 6 associated with R is deflected upward more by a difference between the amounts of the correction for R and B, so that the cross-misconvergence is eliminated.

In each quadrant, the level of cross-misconvergence is highest at a part where the amount of deflection is half in the vertical direction. Thus, the corresponding correction coil 17*a* to 17*d* is preferably set at a position appropriate to that half amount of deflection.

For the simplicity of description, the correction coil 17*a* has been explained as if it were located on a right-hand vertical boundary 21*a* of the deflection region 21. In reality, however, the correction coil 17*a* is provided on the outer surface of the resin frame 15 of the deflection device 9. Specifically, the correction coil 17*a* is set at a position K that is located on an extension of a line linking a center point O of the deflection region 21 and a midpoint J of the upper half of the boundary 21*a*.

Suppose that an angle which the line O-J forms with the horizontal axis is θ as shown in FIG. 7. In this case, when an aspect ratio is 4:3, which is normal, $\tan\theta=(3/2)/4=3/8$. Thus, the angle θ is calculated at 27°. The correction coil 17*a* is then set at the position 27° high from the horizontal axis of the resin frame 15. Similarly, the other correction coils 17*b* to 17*d* are respectively set for the corresponding quadrants.

Figure 8:
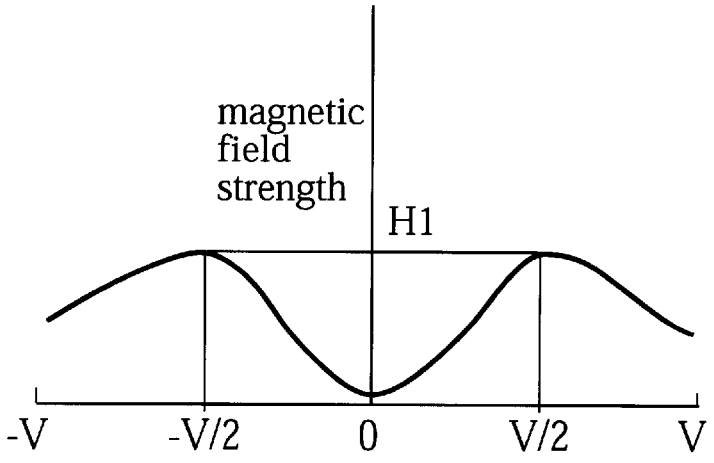
FIG. 8 is a graph showing a relation between the amount of vertical deflection of the electron beams and a strength of the magnetic fields generated by the correction coils.

FIG. 8 is a graph showing a relation between the amount of deflection of the electron beams 6 in the vertical direction and a strength of the magnetic fields generated by the correction coils 17*a* to 17*d*.

A lateral axis of the graph indicates a position of the electron beams 6 deflected in the vertical direction in the deflection region 21 or the fluorescent screen 2. On this lateral axis, 0 indicates the position of the horizontal axis, V indicates the position of the top edge, and −V indicates the position of the bottom edge.

A vertical axis of the graph indicates a strength of the corrective magnetic field. When V is positive, i.e. in the case of the upward deflection, the vertical axis indicates the magnetic field strength of the correction coil 17*a* or 17*c*.

When V is negative, i.e. in the case of the downward deflection, the vertical axis indicates the magnetic field strength of the correction coils 17*b* or 17*d*.

As shown in FIG. 8, when the electron beams 6 reach the horizontal axis of the fluorescent screen 2, the vertical deflection current is 0 and, therefore the magnetic fields generated by the correction coils 17*a* to 17*d* are all 0. Basically, cross-misconvergence does not occur around the horizontal axis. Thus, there is no problem if the corrective magnetic field is 0 when the electron beams 6 reach the horizontal axis.

As explained above using FIG. 5, the vertical deflection current is supplied to the correction coils 17*a* to 17*d* in series to the vertical deflection coils 16. The strength of the magnetic fields generated by the correction coils 17*a* to 17*d* becomes larger in sync with the vertical deflection current as the electron beams 6 are deflected upward or downward. The strength reaches a predetermined value H1 in the vicinity of V/2 or −V/2.

However, a saturable-type ferrite core is used for forming each correction coil 17*a* to 17*d* as stated above. As such, the magnetic field strength can be set to be saturated at H1 by appropriately setting material and dimensions of the saturable-type ferrite core. By doing so, the strength of the corrective magnetic fields becomes smaller as the electron beams 6 are deflected upward or downward with a subsequent increase in the vertical deflection current.

Accordingly, it is preferable that the correction coils 17*a* to 17*d* having the saturable characteristic as shown in FIG. 8 are set at the appropriate positions so that the corrective magnetic fields act on the electron beams 6 most when they are vertically deflected in the vicinity of V/2 and −V/2 (see FIG. 7). Through this arrangement of the correction coils 17*a* to 17*d*, the cross-misconvergence occurring in the central strips is corrected most effectively and convergence around the horizontal axis is retained. Also, convergence around the top and bottom edges of the deflection region 21 can be nearly retained. Consequently, an optimum correction for the cross-misconvergence is realized.

Suppose that the maximum amount of correction for cross-misconvergence (that is, the maximum deviation between the R and B beams in the vertical direction) is D, and that a vertical length of the fluorescent screen 2 of the color CRT 100 is 2L. Also suppose that the strength (the maximum strength) of the magnetic field generated by the vertical deflection coils 16 when the electron beams 6 are deflected to the upper edge (vertically deflected by L) is H2. In this case, in order to vertically shift a beam (the R beam, for instance) located nearest to the corresponding correction coil by D to have it agree with another beam (the B beam, for instance) located away from the correction coil, magnetic fields having the strength obtained by multiplying H2 by a percentage calculated from r=D/L×100(%) should be generated at a position where the maximum amount of correction D is needed in the vertical direction. For the generation of such magnetic fields, the number of coil turns, the amount of current to be supplied, etc. are appropriately set for the correction coils. A relation expressed as the following equation is established.

$$H1=H2\times(D/L) \quad (1)$$

However, a magnetic force of the correction coil deflecting the beam located nearest to that correction coil also slightly acts, in the same direction, on the beam located away from the correction coil. Specifically, in the first quadrant shown in FIG. 7 for example, a magnetic force of the correction coil 17*a* deflecting the R beam also slightly acts on the B beam. For this reason, it is desirable to set the value of H1 a little greater than the value obtained by calculating the equation (1) to completely eliminate the cross-misconvergence between these two rasters. In reality, with reference to the value obtained by calculating the equation (1), a manufacturing worker watches the fluorescent screen closely and makes fine adjustments to the value of H1 in the prototyping stage. This means that the manufacturing worker sets the value H1 so that no cross-misconvergence will occur.

A detailed description is given using an example as follows. When the screen size of the color CRT 100 is 19-inch with the aspect ration 4:3, the maximum amount of correction for the cross-misconvergence would be approximately 0.05 mm to 1 mm. With this screen size, 2L is 256 mm. When D=0.05 mm, r is calculated at (0.05/132.5)×100=0.038(%). When D=1 mm, on the other hand, r is calculated at (1/132.5)×100=0.75(%). Thus, in the present example, H1 is determined to be 0.038% to 0.05% as a guide with respect to H2 through the stated fine adjustment process in the prototyping stage, and ultimate specifications of the correction coils 17*a* to 17*d* are determined.

The following experiment was conducted to check cross-misconvergence using a 19-inch front-flat configuration color CRT. For this experiment, a correction coil was made from 40 turns of a copper wire that was 0.2 mm in diameter, wound on a prismatic ferrite core that was 25 mm in height and 1 mm long and wide in a transverse cross section. For manufacturing the prismatic ferrite core, Mg—Zn base, Mn—Zn base, or Ni—Zn base material was used. For the first quadrant, this correction coil was set on the outer surface of the resin frame 15 of the deflection device 9 at the position about 27° high from the horizontal axis. Similarly, the correction coil is set at the corresponding position for each of the other three quadrants. With this construction, cross-misconvergence did not occur to the fluorescent screen of the CRT at all.

Modifications

The present invention has been described in accordance with the stated embodiment. It should be obvious that the present invention is not limited to the embodiment, so that the following modifications can be made.

(1) In the present embodiment, a saturable-type ferrite core is used for forming each correction coil 17*a* to 17*d*, and these correction coils 17*a* to 17*d* are connected in series to the vertical deflection coil 16. As a result, the magnetic field strength changes with the amount of deflection of the electron beams 6 in the vertical direction, as shown in FIG. 8. However, constructions described in the following (1-1) and (1-2) may be applied.

(1-1) There may be additionally provided with a current generation device which generates a sawtooth current that is in phase with and proportional to the vertical deflection current generated by the vertical deflection circuit 207. This current generation device may be used as a controller dedicated to the generation of the corrective magnetic fields by the correction coils 17*a* to 17*d*.

(1-2) The saturable-type cores are used for forming the correction coils 17*a* to 17*d* in the stated embodiment. However, normal cores may be used instead of the saturable-type cores. In this case, the magnetic field strength can change in much the same manner as shown in FIG. 8 only by controlling the amount of current to be supplied.

Figure 9:
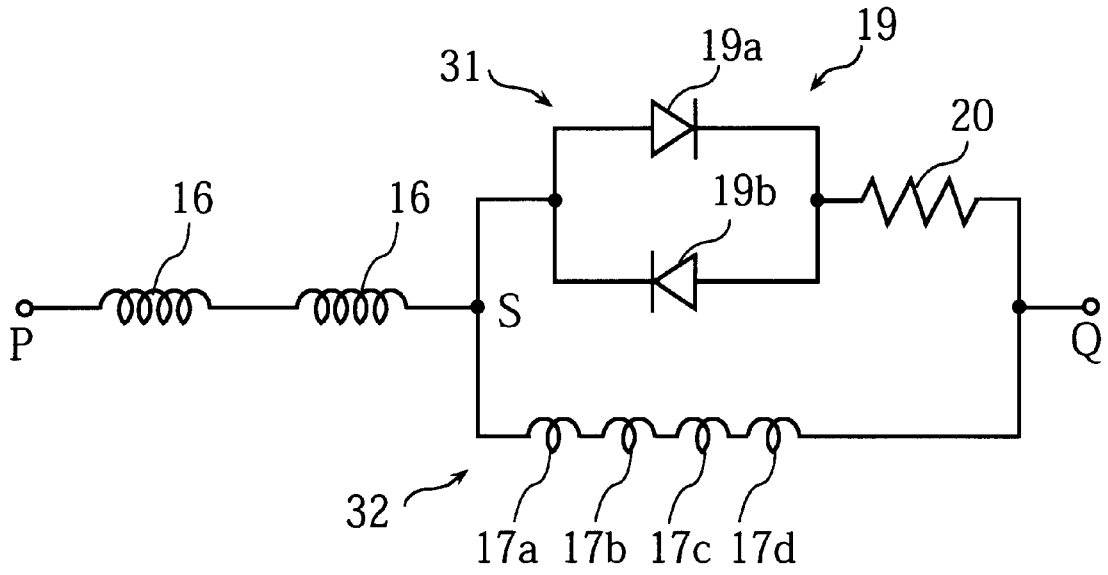
FIG. 9 shows another connection example of the correction coils and the vertical deflection coils.
Figure 10:
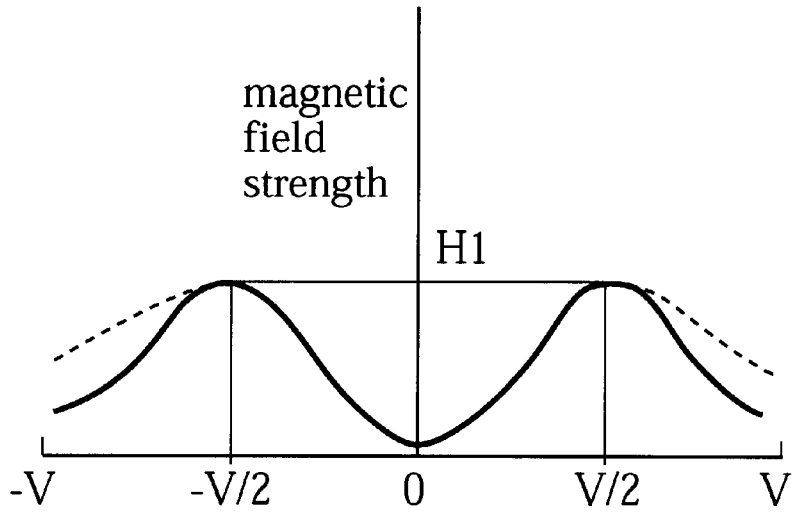
FIG. 10 is a graph showing a relation between the amount of vertical deflection of the electron beams and a strength of the magnetic fields generated by the correction coils when the correction coils and the vertical coils are connected as shown in FIG. 9.

FIG. 9 shows an example of such a current control circuit, and FIG. 10 is a graph showing a relation between the amount of deflection of the electron beams and a strength of the magnetic fields when the current control circuit is used.

In FIG. 10, as is the case with FIG. 8, a lateral axis indicates a position of the electron beams deflected in the vertical direction on the deflection region 21 or the fluorescent screen 2. A vertical axis of the graph indicates a strength of the magnetic field generated by the correction coil 17*a* or 17*c* when V is positive while indicating the strength of the magnetic field generated by the correction coils 17*b* or 17*d* when V is negative.

In the current control circuit of the present modification shown in FIG. 9, a first circuit 31 is connected in parallel to a second circuit 32 and this parallel circuit is connected in series to the pair of the vertical deflection coils 16 via a connection point S. The first circuit 31 is formed by connecting a switching circuit 19 in series to a resistance 20. The switching circuit 19 is formed by connecting diodes 19*a* and 19*b* in parallel, the diodes 19*a* and 19*b* facing opposite directions. The second circuit 32 is formed by connecting the correction coils 17*a* to 17*d* in series. As in the case shown in FIG. 5, both ends P and Q of this current control circuit are connected to the vertical deflection circuit 207 so that the vertical deflection current is supplied between P and Q.

The diodes 19*a* and 19*b* have the same characteristics and one of the diodes 19*a* and 19*b* allows a current to pass when a forward voltage equal to or greater than a predetermined voltage E1 is applied. As the voltage E1, a voltage applied to each end of the switching circuit 19 when the electron beams 6 are deflected to the central strip is set.

Suppose that the vertical deflection current is supplied in the direction from P to Q for the upward deflection while it is supplied in the direction from Q to P for the downward deflection. Although the same effect can be achieved for both cases of the upward deflection and the downward deflection, an explanation will be given only for the case of the upward deflection.

In the case of the upward deflection, when the amount of deflection is 0 to V/2, the vertical deflection current is small and so is a separated voltage at the point S. Thus, both of the diodes 19*a* and 19*b* of the switching circuit 19 remain closed, so that the vertical deflection current is supplied only to the correction coils 17*a* to 17*d* of the second circuit 32. The live circuit at this moment is in the same state as shown in FIG. 5, meaning that the magnetic field strength increases as shown in FIG. 8.

However, as the amount of deflection approaches V/2, a potential at the point S increases. Then, when the voltage E1 is applied to both ends of the switching circuit 19, the current starts to pass through the diode 19*a* and the vertical deflection current is accordingly supplied to the resistance 20. For this reason, although the vertical deflection current is increased thereafter, the current supplied to the correction coils 17*a* to 17*d* are decreased and so are the corrective magnetic fields generated by the correction coils 17*a* to 17*d*. By appropriately adjusting a resistance value of the resistance 20, the strength of the corrective magnetic fields gradually decreases after the amount of deflection exceeds V/2, as shown in FIG. 10.

Broken lines drawn in FIG. 10 indicate the decrease in the strength of the corrective magnetic fields that is shown in FIG. 8. As clearly can be seen, after the amount of deflection exceeds V/2, the strength is decreased a little more sharply in the present modification as compared with the stated embodiment shown in FIG. 8. However, the strength of the corrective magnetic fields is largest when the amount of deflection is V/2 at which the correction for the cross-misconvergence is most required. Also, the strength is decreased to 0 or nearly 0 around the horizontal axis and the top edge where no correction is required. Therefore, the cross-misconvergence can be reliably corrected for each central strip and the convergence in the other areas of the deflection region 21 is not adversely affected in this modification as is the case with the stated embodiment. This can be also said to the case of downward deflection.

(2) In the stated embodiment, it is preferable to provide one correction coil for each quadrant, meaning that four correction coils in total are preferably provided. The total number of correction coils may be more than four. However, taking account of the balance among the corrective magnetic fields of the four quadrants, the same number of correction coils should be provided for each quadrant. Also, many correction coils may adversely affect on the magnetic fields of neighboring quadrants. Therefore, when more than four correction coils are provided, eight coils in total would be suitable.

When a plurality of correction coils are provided for each quadrant, their setting positions, ratio of the numbers of coil turns, current ratio, directions of the current, and the like should be appropriately set so that the total strengths of the magnetic fields generated by the plurality of correction coils change as shown in FIG. 8.

(3) In the stated embodiment, each correction coil is set at the position 27° high or low from the horizontal axis of the deflection region for each quadrant. However, when cross-misconvergence occurs in a different area for each quadrant, the corresponding correction coil may be set at a position located close to the area where the level of cross-misconvergence is highest. Through the appropriate arrangement of the correction coils, an optimum correction for cross-misconvergence can be achieved.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. A color cathode ray tube comprising:

a glass bulb which has a front panel and a fluorescent screen that is set on an inner surface of the front panel;

an in-line electron gun which is provided in the glass bulb and projects a plurality of electron beams onto the fluorescent screen;

a deflection means including a horizontal deflection coil that deflects the electron beams in a horizontal direction and a vertical deflection coil that deflects the electron beams in a vertical direction, the horizontal and vertical deflection coils being arranged outside the glass bulb; and a correction means for generating a corrective magnetic field that is used for correcting cross-misconvergence, a strength of the corrective magnetic field being changed in accordance with an amount of deflection of the electron beams in the vertical direction, said strength of the corrective magnetic field being largest when the electron beams are deflected to a horizontal strip in the middle portion of an upper and lower half of the fluorescent screen, and the correction means further comprising at least one correction coil having a magnetic pole being parallel to a tube axis which begins at the neck and extends through the screen.

2. The color cathode ray tube of claim 1, wherein the correction means changes the strength of the corrective magnetic field so that the strength affecting the electron beams becomes largest when the electron beams are deflected to an area where a greatest amount of correction for the cross-misconvergence is needed and that the strength affecting the electron beams becomes. smallest when the amount of deflection of the electron beams in the vertical direction is zero.

3. The color cathode ray tube of claim 1, wherein the correction means includes:

a plurality of correction coils which respectively generate corrective magnetic fields; and a control means which controls a current to be supplied to the correction coils.

4. The color cathode ray tube of claim 3, wherein the control means increases the current to be supplied to the correction coils in accordance with the amount of deflection of the electron beams in the vertical direction, wherein each of the correction coils is formed by winding a solenoid around a saturable core, a strength of the corrective magnetic fields being largest when the current supplied to the correction coils reaches a predetermined value and being decreased owing to saturation of the saturable cores after the current exceeds the predetermined value.

5. The color cathode ray tube of claim 4, wherein the control means supplies a current to the correction coils, the current changing proportional to a vertical deflection current supplied to the vertical deflection coil.

6. The color cathode ray tube of claim 4, wherein the deflection means includes a vertical deflection control means which controls the vertical deflection current to be supplied to the vertical deflection coil, wherein the vertical deflection control means also serves as the control means and supplies the vertical deflection current to the correction coils and vertical deflection coil that are connected in series.

7. The color cathode ray tube of claim 4, wherein the correction coils are provided outside a section of the glass bulb by a plane perpendicular to a tube axis which begins at the neck and extends through the screen, between the deflection means and the front panel, the electron beams passing the plane within a rectangle deflection region, the correction coils being located outside the glass bulb to a right and left of the rectangular deflection region no lower than a bottom edge of the rectangular deflection region and no higher than a top edge of the rectangular deflection region, and at least one correction coil being provided for each of four quadrants of the rectangular deflection region, with a center point of the rectangular deflection region being an origin.

8. The color cathode ray tube of claim 7, wherein the correction coil provided for each quadrant is set at a position in the vertical direction, corresponding to an area in which a greatest amount of correction for the cross-misconvergence is needed.

9. The color cathode ray tube of claim 8, wherein the area corresponds to a position to which the electron beams are vertically deflected by half of a total amount of deflection measured in the vertical direction from a horizontal axis passing through the origin.

10. The color cathode ray tube of claim 1, wherein the correction means includes a plurality of correction coils which respectively generate corrective magnetic fields, wherein the plurality of correction coils are connected in series to form a first circuit that is connected in parallel to a second circuit in which a switching circuit is connected in series to a resistive element, the switching circuit allowing a current to pass when a predetermined voltage is applied in a forward or opposite direction, wherein a current is supplied to the parallel circuit composed of the first and second circuits, the current changing proportional to a vertical deflection current supplied to the vertical deflection coil.

11. The color cathode ray tube of claim 10, wherein the predetermined voltage is equivalent to a voltage across both ends of the switching circuit when the electron beams are deflected to an area in which a greatest amount of correction for the cross-misconvergence is needed.

12. The color cathode ray tube of claim 11, wherein the correction coils are provided outside a section of the glass bulb by a plane perpendicular to a tube axis which begins at the neck and extends through the screen, between the deflection means and the front panel, the electron beams passing the plane within a rectangle deflection region, the correction coils being located outside the glass bulb to a right and left of the rectangular deflection region no lower than a bottom edge of the rectangular deflection region and no higher than a top edge of the rectangular deflection region, and at least one correction coil being provided for each of four quadrants of the rectangular deflection region, with a center point of the rectangular deflection region being an origin.

13. The color cathode ray tube of claim 12, wherein the correction coil provided for each quadrant is set at a position in the vertical direction, corresponding to an area in which a greatest amount of correction for the cross-misconvergence is needed.

* * * * *